US008070137B2

(12) United States Patent
Bennett

(10) Patent No.: US 8,070,137 B2
(45) Date of Patent: Dec. 6, 2011

(54) HANDRAIL ASSEMBLY

(75) Inventor: Matthew Bennett, New Berlin, WI (US)

(73) Assignee: InPro Corporation, Muskego, WI (US)

( * ) Notice: Subject to any disclaimer, the term of this patent is extended or adjusted under 35 U.S.C. 154(b) by 188 days.

(21) Appl. No.: 12/418,303

(22) Filed: Apr. 3, 2009

(65) Prior Publication Data

US 2010/0252792 A1 Oct. 7, 2010

(51) Int. Cl.
*E04F 11/18* (2006.01)

(52) U.S. Cl. ..... 256/65.16; 256/65.15

(58) Field of Classification Search ..... 256/59, 256/65.16, 65.15, 65.01; 403/292, 306, DIG. 15
See application file for complete search history.

(56) References Cited

U.S. PATENT DOCUMENTS

| | | | | | |
|---|---|---|---|---|---|
| 2,997,317 | A | * | 8/1961 | Scott | 285/397 |
| 3,164,354 | A | * | 1/1965 | Murdock | 248/251 |
| 3,223,371 | A | * | 12/1965 | Miller | 248/251 |
| 3,333,823 | A | * | 8/1967 | Genauer et al. | 256/65.08 |
| 3,385,567 | A | * | 5/1968 | Case et al. | 256/24 |
| 3,414,236 | A | * | 12/1968 | Siegal | 256/22 |
| 3,433,460 | A | * | 3/1969 | Kusel et al. | 256/65.16 |
| 3,596,880 | A | * | 8/1971 | Greenberg | 256/65.1 |
| 3,707,276 | A | * | 12/1972 | Francis et al. | 256/22 |
| 3,813,071 | A | | 5/1974 | Noryd | |
| 3,962,774 | A | | 6/1976 | Noro | |
| 3,981,118 | A | | 9/1976 | Johnson et al. | |
| 4,050,828 | A | | 9/1977 | Noro | |
| 4,161,769 | A | | 7/1979 | Elliott | |
| 4,220,316 | A | * | 9/1980 | Naka et al. | 256/59 |
| 4,373,310 | A | | 2/1983 | Dean | |
| 4,451,025 | A | | 5/1984 | Spera | |
| 4,602,766 | A | | 7/1986 | Naka et al. | |
| 4,646,490 | A | | 3/1987 | Naka et al. | |
| 4,705,155 | A | | 11/1987 | Kanamori | |
| 4,750,713 | A | | 6/1988 | Hirose | |
| 4,858,087 | A | | 8/1989 | Hartshorn | |
| 5,200,240 | A | * | 4/1993 | Baker | 428/34.1 |
| 5,303,900 | A | | 4/1994 | Zulick, III et al. | |
| 5,427,359 | A | * | 6/1995 | Moulton | 256/59 |
| 5,469,682 | A | * | 11/1995 | Knight | 52/718.01 |
| 5,529,288 | A | * | 6/1996 | Cheng-I | 256/65.16 |
| 5,544,865 | A | * | 8/1996 | Abbaticchio | 256/67 |
| 5,720,567 | A | * | 2/1998 | Rinderer | 403/314 |
| 5,787,664 | A | | 8/1998 | Hollander et al. | |
| 5,908,185 | A | | 6/1999 | Collette et al. | |
| 6,017,019 | A | | 1/2000 | Erwin | |
| 6,036,156 | A | | 3/2000 | Collette et al. | |
| 6,270,058 | B1 | * | 8/2001 | Williams et al. | 256/59 |
| 6,311,957 | B1 | | 11/2001 | Driscoll et al. | |
| 6,324,988 | B1 | * | 12/2001 | Svensson | 104/89 |
| 6,386,518 | B1 | | 5/2002 | Shreiner | |

(Continued)

*Primary Examiner* — Joshua Kennedy
(74) *Attorney, Agent, or Firm* — Boyle Fredrickson, S.C.

(57) ABSTRACT

A handrail assembly configured for grasping by a pedestrian includes a railing formed from an extruded metal such as aluminum. The railing includes an integrally formed channel running a length thereof within the interior of the railing. The channel includes a threaded portion for receiving a fastener for mounting the handrail assembly to a mounting assembly for interconnection to a wall. The mounting assembly includes a fastener secured within a bracket post that extends downwardly from the railing of the handrail assembly. The fastener of the bracket post is self-threaded onto the railing through a pilot hole drilled into the bottom surface of the railing. The bracket post is coupled to a bracket by way of a fastener to thereby mount the bracket to a wall so as to secure the handrail assembly to the wall.

18 Claims, 6 Drawing Sheets

U.S. PATENT DOCUMENTS

| | | | | |
|---|---|---|---|---|
| 6,418,583 | B1 | 7/2002 | Eyre et al. | |
| 6,557,832 | B2 | 5/2003 | Shreiner | |
| 6,595,497 | B1 | 7/2003 | Linford et al. | |
| 6,715,242 | B1 | 4/2004 | Green et al. | |
| 6,758,460 | B1 | 7/2004 | Driscoll et al. | |
| 6,802,496 | B1 | 10/2004 | Preta | |
| 7,121,530 | B1 | 10/2006 | Preta | |
| 7,159,363 | B1 | 1/2007 | Green et al. | |
| 7,243,775 | B2 | 7/2007 | Novacek et al. | |
| 7,300,059 | B2 * | 11/2007 | Caruso | 273/400 |
| 7,815,389 | B2 * | 10/2010 | Wagner et al. | 403/306 |
| 2005/0166525 | A1 * | 8/2005 | Moulton | 52/698 |
| 2007/0094994 | A1 | 5/2007 | Singleton | |
| 2007/0206989 | A1 * | 9/2007 | Wagner et al. | 403/297 |
| 2008/0265232 | A1 | 10/2008 | Terrels et al. | |
| 2009/0242864 | A1 * | 10/2009 | Carney | 256/59 |

* cited by examiner

HANDRAIL ASSEMBLY

BACKGROUND OF THE INVENTION

The present invention relates generally to handrails, and more particularly, to a handrail assembly that includes an internal channel for allowing a bracket to self-thread into the handrail.

Handrail assemblies constructed from aluminum, steel, and other such metals are commonly used in a variety of applications and locations. For example, such handrails are often used in institutional locations such as hospitals, elderly care facilities, and other such public buildings. Such handrail assemblies typically include a generally horizontally extending handrail railing for grasping by a pedestrian. The handrail railing is mounted to the wall by way of a bracket assembly that is connected to the bottom of the rails. Such bracket assemblies typically require arm or saddle members for interconnection between the bottom of the handrail railing and the wall.

Bracket assemblies of this type are often difficult to assemble as they require a number of tools for mounting the handrail railing to the bracket assemblies. In addition, such bracket assemblies are known to interfere with the ability of pedestrians to grasp the handrail railing with their hands, thereby creating an unsafe environment especially when used in hospitals, elderly care facilities, and other locations where the handrail assemblies will be utilized to support individuals requiring the handrail for support as they walk. Further, these bracket assemblies are often quite conspicuous and create an aesthetically displeasing look.

Oftentimes, especially in hospitals and elderly care facilities, wall guards are provided along with the handrail assemblies for protecting the wall from the wear and tear associated with use in such facilities where the walls and corners of walls will be exposed to damage from impacts with various kinds of wheeled vehicles such as stretchers, wheelchairs, dining carts, and the like. Traditional handrail assemblies employing bracket assemblies make it difficult to employ wall guards.

Therefore, there is a need for a handrail assembly that is relatively simple and easy to assembly. Further, there is a need for a handrail assembly that does not interfere with a pedestrian's ability to grasp the handrail. In addition, there is a need for a handrail assembly that is aesthetically pleasing. Finally, there is also a need for a handrail assembly that is easy to interconnect with wall guard assemblies of the kind commonly found in hospitals and elder care facilities.

BRIEF DESCRIPTION OF THE INVENTION

The present invention provides a handrail assembly for use in a variety of locations including hospitals, elder care facilities, and other such public places. The handrail assembly according to the present invention includes a generally elongated railing that is preferably constructed out of aluminum or another such sturdy material and is configured for grasping by a pedestrian. The railing may include rounded corner members at the ends thereof around corners of a wall or other surface. The railing is rounded and has a generally flat bottom surface that is configured for interconnection with a mounting assembly. The railing is preferably formed as an extrusion having an integral internal channel extending along a length of the railing. The channel has a T-shaped cross-section, wherein a vertically extending portion of the cross-section is grooved. The grooved portion defines a threaded surface for interconnecting with a portion of the mounting assembly.

The railing is mounted to the wall by way of a number of spaced mounting assemblies. The mounting assemblies include a downwardly extending bracket post and a bracket. The bracket post houses a threaded fastener such as a screw that extends upwardly therefrom. The threaded fastener is configured for insertion through the bottom wall of the railing for engaging the grooved portion of the channel. As such, the bracket post is simply threaded onto the railing for interconnection therewith without requiring any tools for coupling to one another. Further, the bracket post may be interconnected with the railing at any point along a length of the railing. Thus, the handrail assembly of the present invention may be configured for use in a wide variety of locations requiring a multitude of different mounting configurations. The bracket post is secured to a wall-mounted bracket by way of a fastener that couples the bracket post to the bracket and secures the bracket to the wall. The bracket post may include an extension that extends downwardly therefrom for allowing the mounting of a wall guard assembly thereto.

The simple design of the mounting assembly provides a handrail assembly that does not interfere with a pedestrian's ability to grasp the handrail and that is relatively easy to assemble. It further provides a handrail assembly that is aesthetically pleasing and that allows simple interconnection with wall guards.

It is appreciated that the aspects and features of the invention summarized above are not limited to any one particular embodiment of the invention. That is, many or all of the aspects above may be achieved with any particular embodiment of the invention. Those skilled in the art will appreciate that the invention may be embodied in a manner preferential to one aspect or group of aspects and advantages as taught herein. These and various other aspects, features, and advantages of the present invention will be made apparent from the following detailed description and the drawings.

BRIEF DESCRIPTION OF THE DRAWINGS

The drawings illustrate preferred embodiments presently contemplated for carrying out the invention.

DETAILED DESCRIPTION OF THE PREFERRED EMBODIMENT

Figure 1:
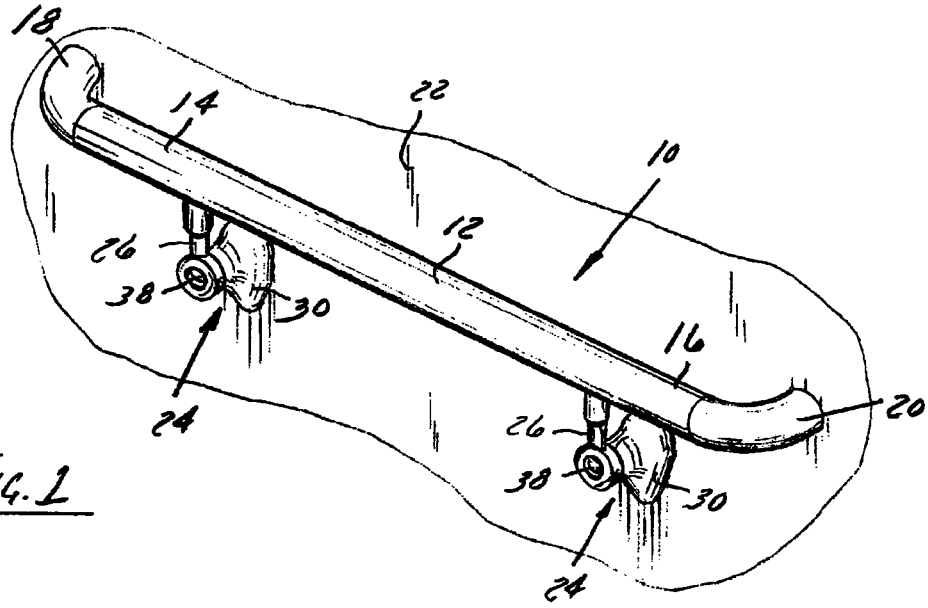
FIG. 1 is an isometric view of a handrail assembly according to the present invention.

Referring now to the drawings, and initially to FIG. 1, a handrail assembly 10 constructed in accordance with the presented invention is shown. The handrail assembly 10 is preferably constructed from extruded aluminum or a material having similar such characteristics. Handrail assembly 10 has an elongated railing 12 having a first end 14 and a second end 16. The elongated body has a generally rounded cross-section having a relatively flat bottom surface 28 (See FIG. 3). Each of first end 14 and second end 16 are attached to a semi-arcuate corner piece 18 and 20 respectively. Corner pieces 18 and 20 are adapted for attachment to a wall 22 for providing a unitary handrail structure. The railing 12 of the handrail assembly 10 according to the present invention is configured for grasping by a pedestrian. Accordingly, the body of the handrail assembly 10 is preferably sized and shaped for accommodating a pedestrian's fingers and/or hand.

The railing 12 is attached to the wall 22 by way of a pair of mounting assemblies 24. Mounting assemblies 24 include a bracket post 26 that extends downwardly from a bottom surface 28 (See FIG. 3) of the railing 12. The bracket post 26 is attached to the railing 12 by a bolt 27 as will be described in further detail below. Mounting assemblies 24 further include brackets 30, which are attached directly to the wall 22. Bracket posts 26 are secured to the brackets 30 to thereby secure the railing 12 with respect to the wall 22.

Figure 4:
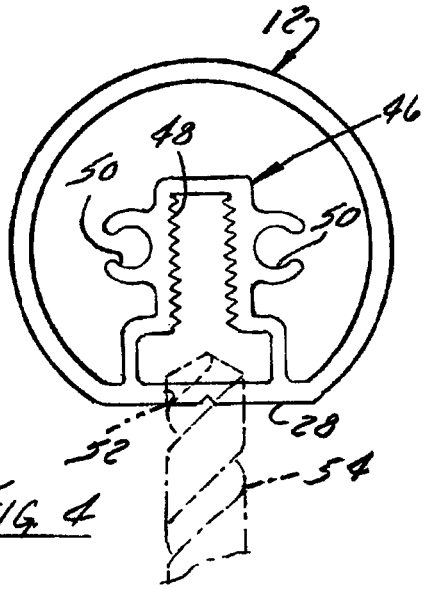
FIG. 4 is a cross-section showing the drilling of pilot holes in a bottom surface of a railing of the handrail assembly.
Figure 5:
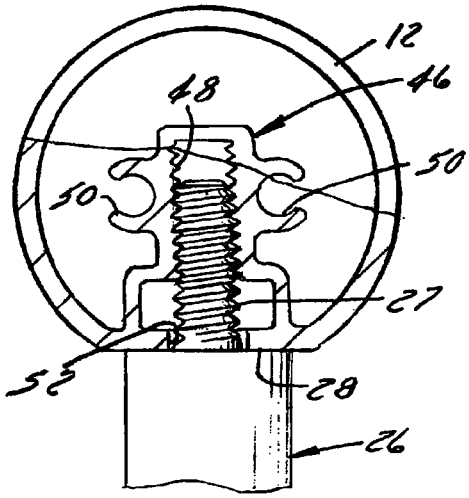
FIG. 5 is a cross-section showing the interconnection of a fastener of the mounting assembly with the handrail according to the present invention.
Figure 7:
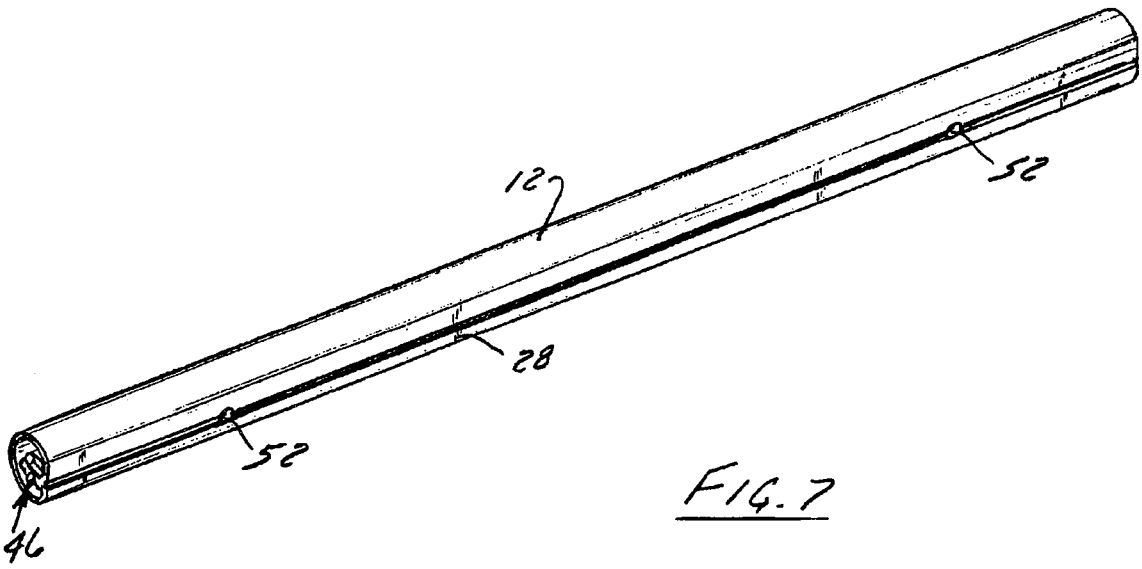
FIG. 7 is an isometric view of the handrail according to the present invention.

Referring momentarily to FIGS. 4-5 and 7, assembly of handrail assembly 10 according to the present invention is shown. A pair of pilot holes 52 are drilled through the bottom wall 28 of the railing 12 of the handrail assembly 10 at user-desired locations along the length of the railing 12 using a drill 54 or similar such tool. Once the pilot holes 52 are drilled, the bolts 27 of the bracket posts 26 are easily inserted through bottom wall 28 of railing 12 for coupling the mounting assemblies 24 to the railing 12 of the handrail assembly 10. A channel 46 is integrally formed within the generally hollow interior of railing 12. Preferably, channel 46 is formed by way of extrusion of the metal thereof. Accordingly, the internal extrusion forms and defines channel 46. Thus, the bolts 27 are simply threaded into a grooved portion 48 of a channel 46. Channel 46 extends along the entire length of railing 12, and thus mounting assemblies 24 may be mounted to railing 12 at any number of different locations to accommodate installation of handrail assembly 10 in a multitude of different locations. The channel 46 extends upwardly from a bottom surface of the interior of the railing 12. The channel 46 defines a hollow, T-shaped cross section and includes a grooved portion 48 over the vertically oriented portion of the T-shaped cross-section. The grooved portion 48 of channel 46 is configured for receiving bolts 27 of bracket posts 26 to couple mounting assemblies 24 to railing 12 of the handrail assembly 10. Each of the outer lateral walls of the channel 46 includes a groove 50 for receiving screws as will be explained in detail herein for joining a number of railings 12 to corner and return members for constructing a relatively longer handrail assembly 10 and for extending the handrail assembly around corners of the wall 22. Accordingly, mounting assemblies 24 and railing 12 are easily coupled to one another without the use of specialized tools or bracket arms and/or saddles as in conventional handrail assemblies.

Figure 2:
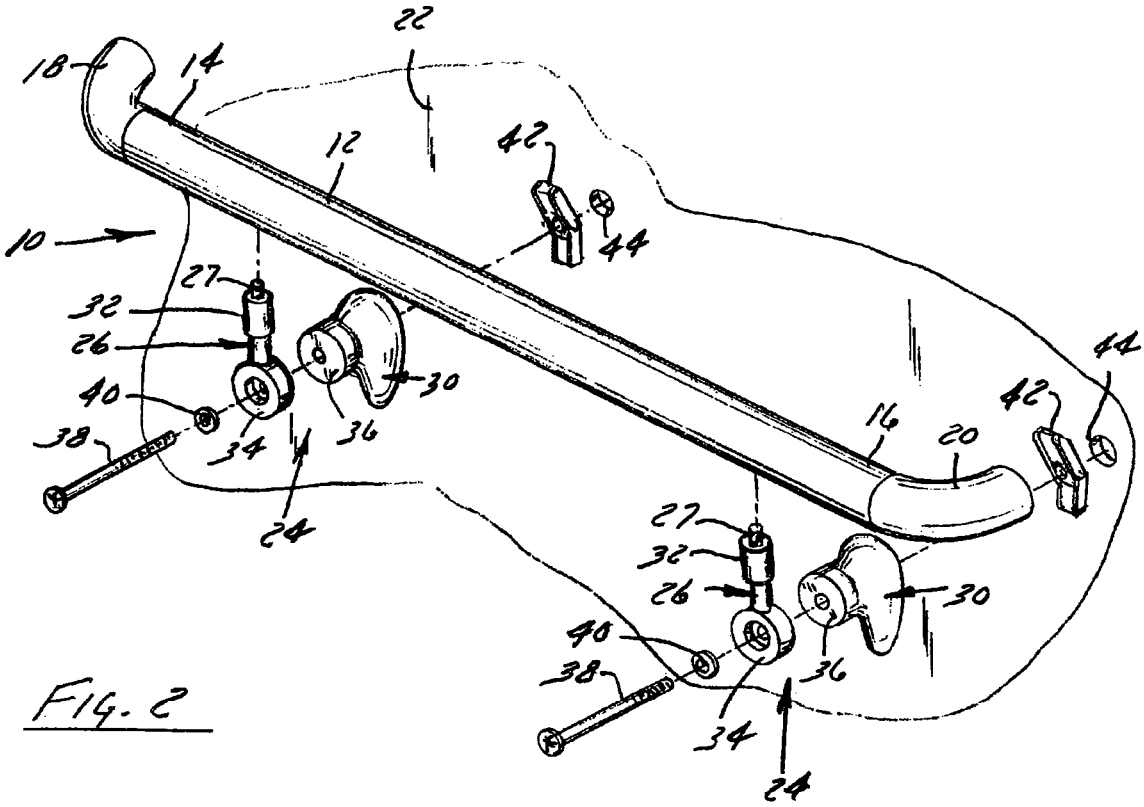
FIG. 2 is a partially exploded isometric view of a mounting assembly of the handrail assembly according to the present invention.
Figure 3:
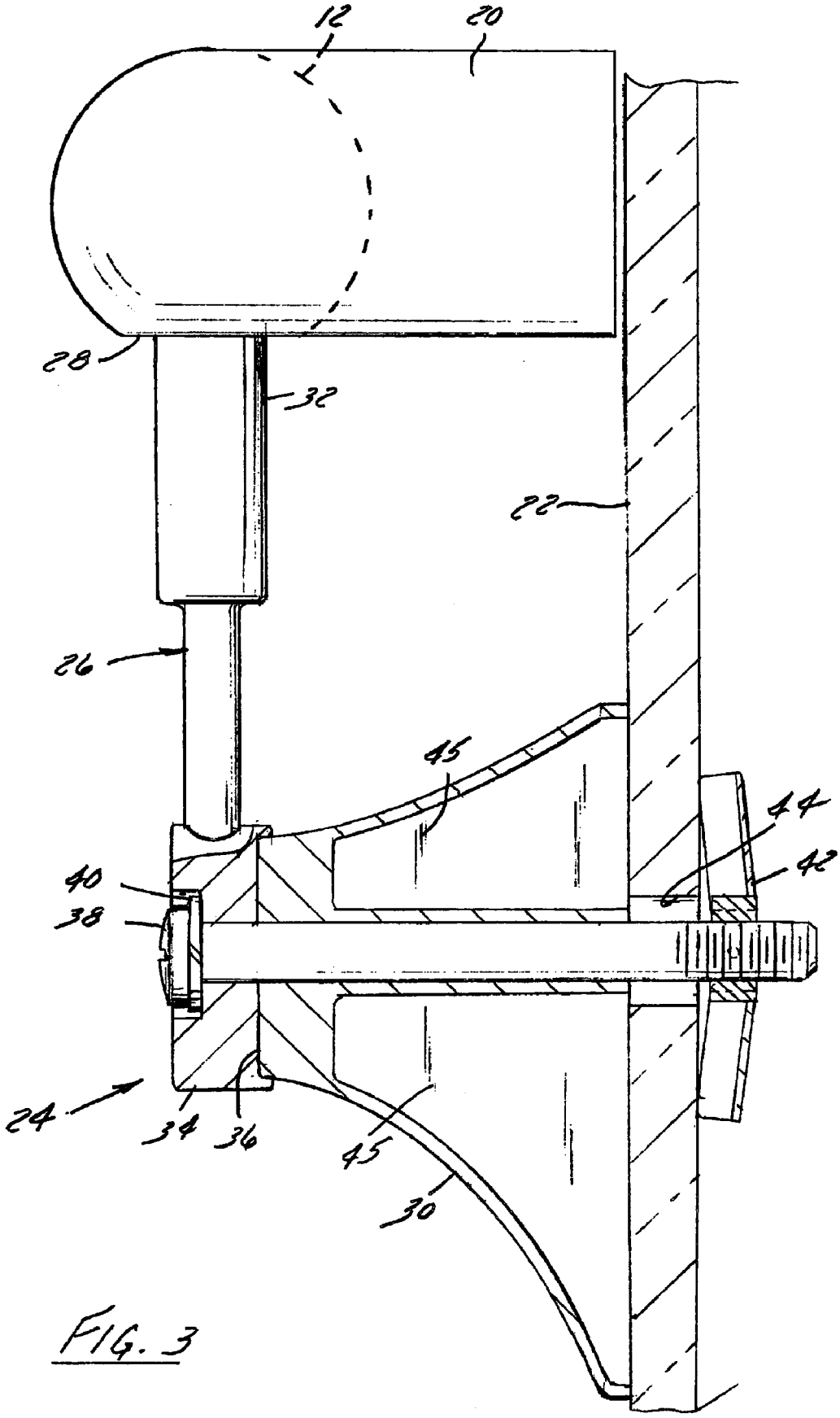
FIG. 3 is a cross-section showing the interconnection of the handrail and the mounting assembly according to the present invention.

Turning now to FIGS. 2 and 3, the mounting assemblies 24 are shown in further detail. Bracket posts 26 have a downwardly extending tubular portion 32 for securing a bolt 27 therein. It is understood that any suitable fastener may be utilized in practicing the present invention. The tubular portion 32 terminates in a generally rounded base 34 that is configured to be mounted onto a corresponding Body 36 of the bracket 30. Body 36 extends outwardly from the wall 22 to operably engage the base 34 of the bracket post 26. The bracket post 26 and bracket 30 are coupled together by way of a screw 38 or a similar such fastening member. A washer 40 is secured between a head of the screw 38 and the base 34 of the bracket post 26. The screw 38 is threaded through each of the holes of the corresponding body portions 34 and 36 of the bracket post 26 and the bracket 30 respectively. A distal end of the screw 38 is received by a toggle bolt 42 for securing the fastener to the wall 22 through a hole 44 therein. The bracket 30 includes a hole therethrough defined by ribs 45 for receiving the screw 38 therethrough. The toggle bolt 42 is configured to fold back as it is inserted through hole 44 in wall 22 such that it may be positioned on an opposite side of the wall 22 such that the screw 38 secures the bracket 30 to the wall 22. The toggle bolt 42 is configured to spring back such that the screw 38 can be tightened to further secure the bracket 30 to the wall 22 as is generally understood in the art. While the mounting assemblies 24 described herein constitute a preferred embodiment of the present invention, it is generally understood that modifications to the mounting assemblies 24 are possible and within the scope of the present invention.

Figure 6:
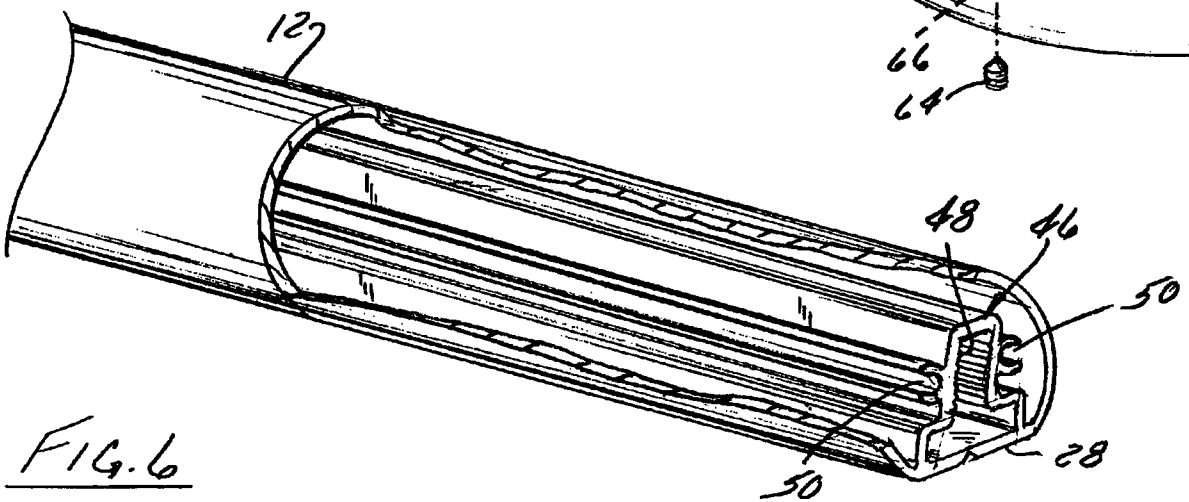
FIG. 6 is a partial isometric cross-section of the railing of the handrail assembly of the present invention showing a channel thereof extending along a length of the railing.

FIG. 6 is a partial cross-section of handrail assembly 10 through railing 12 showing a detailed view of channel 46 as defined by the extrusion. As shown in FIG. 6, channel 46 extends along the entire length of railing 12. Accordingly, pilot holes 52 may be drilled into bottom surface 28 at any point along the length of railing 12. Channel 46 is integrally formed with an interior of railing 12 and extends upwardly from the floor of the interior of railing 12. Channel 46 is generally grooved about a vertically extending portion thereof whereas the horizontally extending portion is generally non-grooved to accommodate the drilling of pilot holes 52 therethrough. Accordingly, bolts 27 may be inserted through bottom surface 28 such that a threaded portion of bolts 27 engages grooved portion 48 such that bolts 27 are easily threaded therein. The extrusion defining channel 46 includes a pair of grooves 50 disposed on each side thereof for coupling railing 12 to another structure such as a corner 20, as will be explained in further detail herein.

Figure 8:
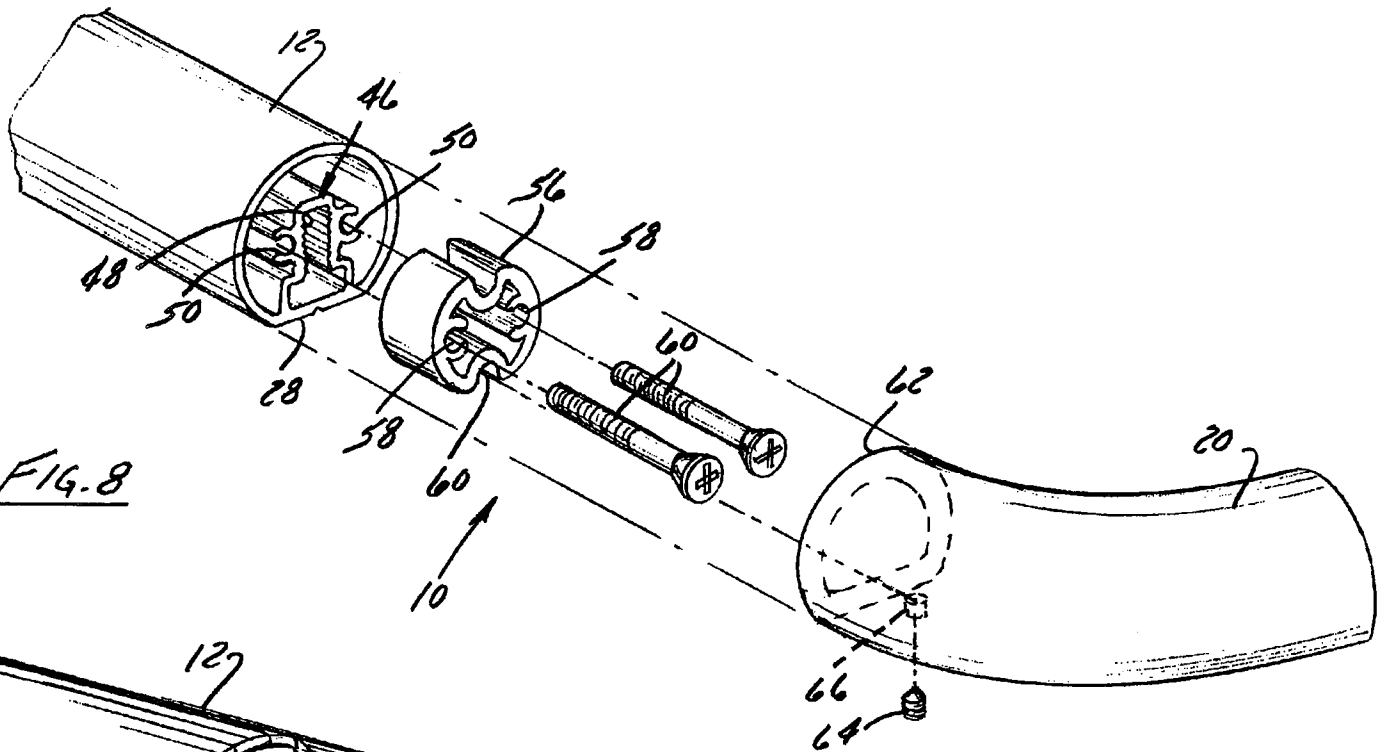
FIG. 8 is an exploded isometric view of the handrail according to the present invention showing the handrail being interconnected with a corner member.

FIG. 8 illustrates the attachment of the railing 12 to the corners 20 of the handrail assembly 10 according to the present invention. A spline 56 is provided for coupling the railing 12 to the corners 20. The spline 56 defines a generally oblong shape defining a substantially hollow interior for securing the spline 56 to the outer surface of the channel 46 within the interior of the railing 12. The hollow interior of the spline 56 defines a pair of grooves 58 configured to align with the grooves 50 of the channel 46. To couple the spline 56 to the railing 12 of the handrail assembly 10, the spline 56 is simply slid over the channel 46 such that the spline 56 is secured therearound. The hollow interior of the spline 56 is sized and shaped to securely fit around the outer surface of the channel 46. A pair of fasteners 60 are provided for further securing the spline 56 to the channel 46. The fasteners 60 are preferably threaded screws but may comprise any other such equivalent fastener. The fasteners 60 are inserted through the corresponding grooves 58 of the spline 56 and grooves 50 of the channel 46. The fasteners are 64 are tightened so as to secure the spline 56 to the railing 12 of the handrail assembly 10.

Once the spline 56 is secured to the railing 12, a portion of the spline 56 projects outwardly from the railing 12 for coupling to an end of the corner 20 of the handrail assembly 10. Preferably, an end 62 of corner 20 is sized and shaped to be simply slid over the spline 56 such that the entirety of the projecting portion of the spline 56 is secured within the interior of the generally hollow corner 20. Accordingly, after assembly, spline 56 is hidden within the interior of the corner 20. Finally, a set screw 64 is provided for further securing the corner 20 to the spline 56. The set screw 64 is inserted through a threaded hole 66 in a bottom surface of the corner 20 and is configured to engage a bottom portion of the spline 56 so as to secure the corner 20 in place. The spline 56 preferably defines a cup point 68 on a bottom surface thereof for receiving the end of the set screw 64. Set screw 64 is configured for engaging cup point 68 and securing the corner 20 with respect to the spline 56. It is understood that set screw 64 may comprise any other such fastener capable of use in carrying out the present invention.

Figure 9:
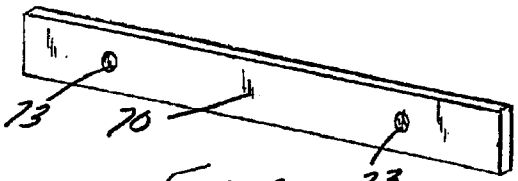
FIG. 9 is an isometric view of a splice member for joining multiple handrails to one another.
Figure 10:
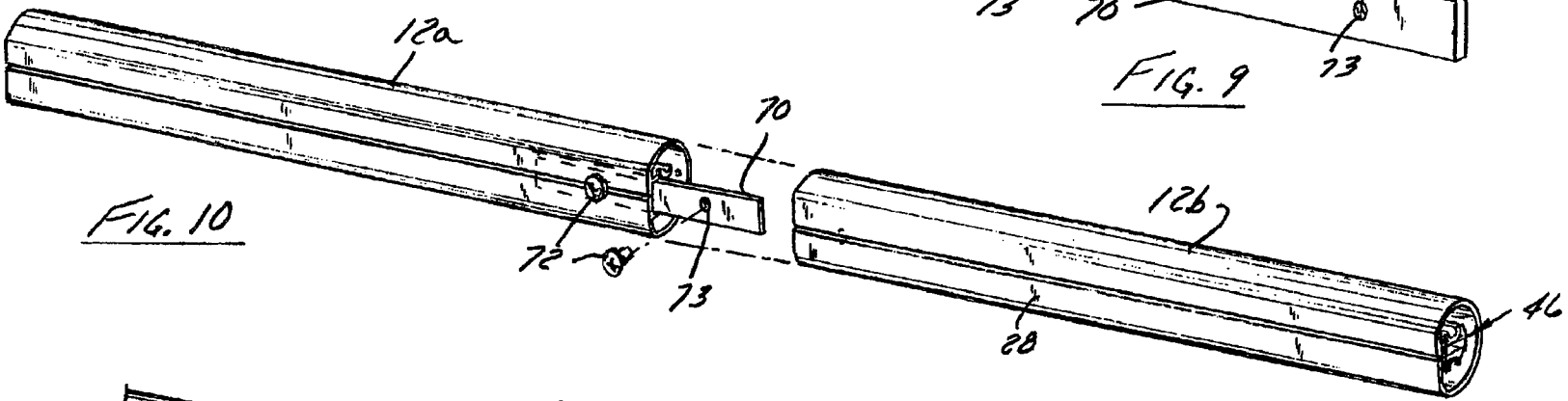
FIG. 10 is an exploded isometric view of a pair of handrails being coupled to one another by way of the splice member.
Figure 11:
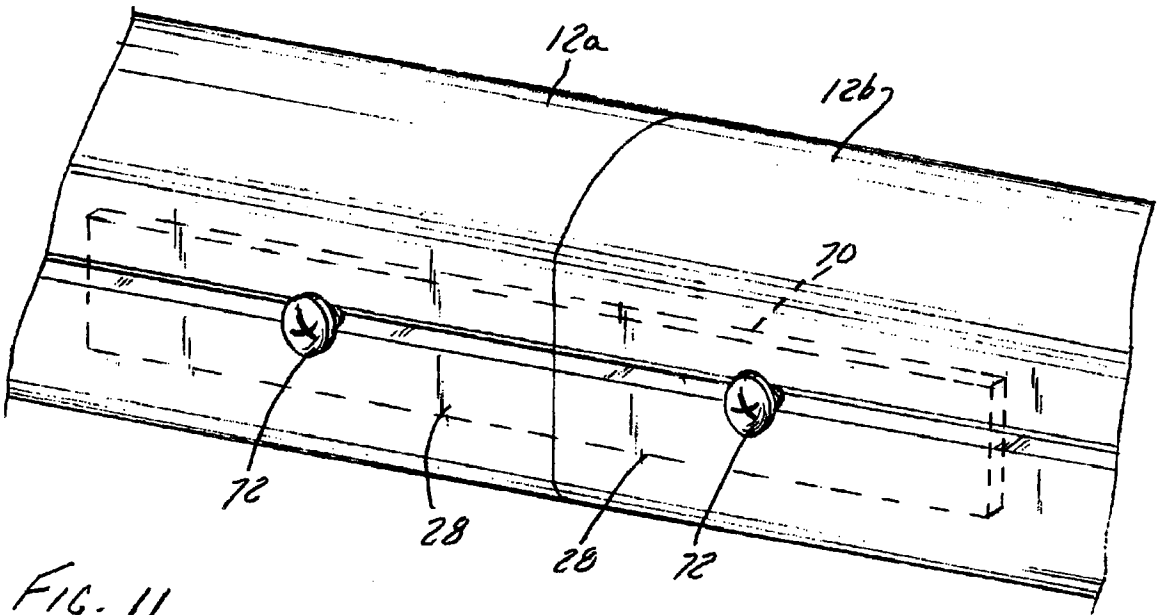
FIG. 11 is an isometric view of a portion of the pair of handrails coupled to one another showing the splice member in phantom.

Referring now to FIGS. 9-11, another embodiment of the handrail assembly 10 according to the present invention is shown. The present embodiment is directed to relatively long handrails such as those longer than twelve feet wherein a splice member 70 is utilized to couple two railings 12 to one another to produce an extended handrail assembly 10. The splice member 70 is configured to be secured within the horizontal portion of the T-shaped cross section of the channel 46. A pair of screws 72 may be inserted through the bottom surface 28 of the adjoining railings 12*a* and 12*b* so as to couple the two bodies to one another. The screws 72 are inserted through the bottom surface 28 to engage a pair of holes 73 spaced along the splice member 70 such that the railings 12*a* and 12*b* are coupled to one another by virtue of the attachment to splice member 70.

Figure 12:
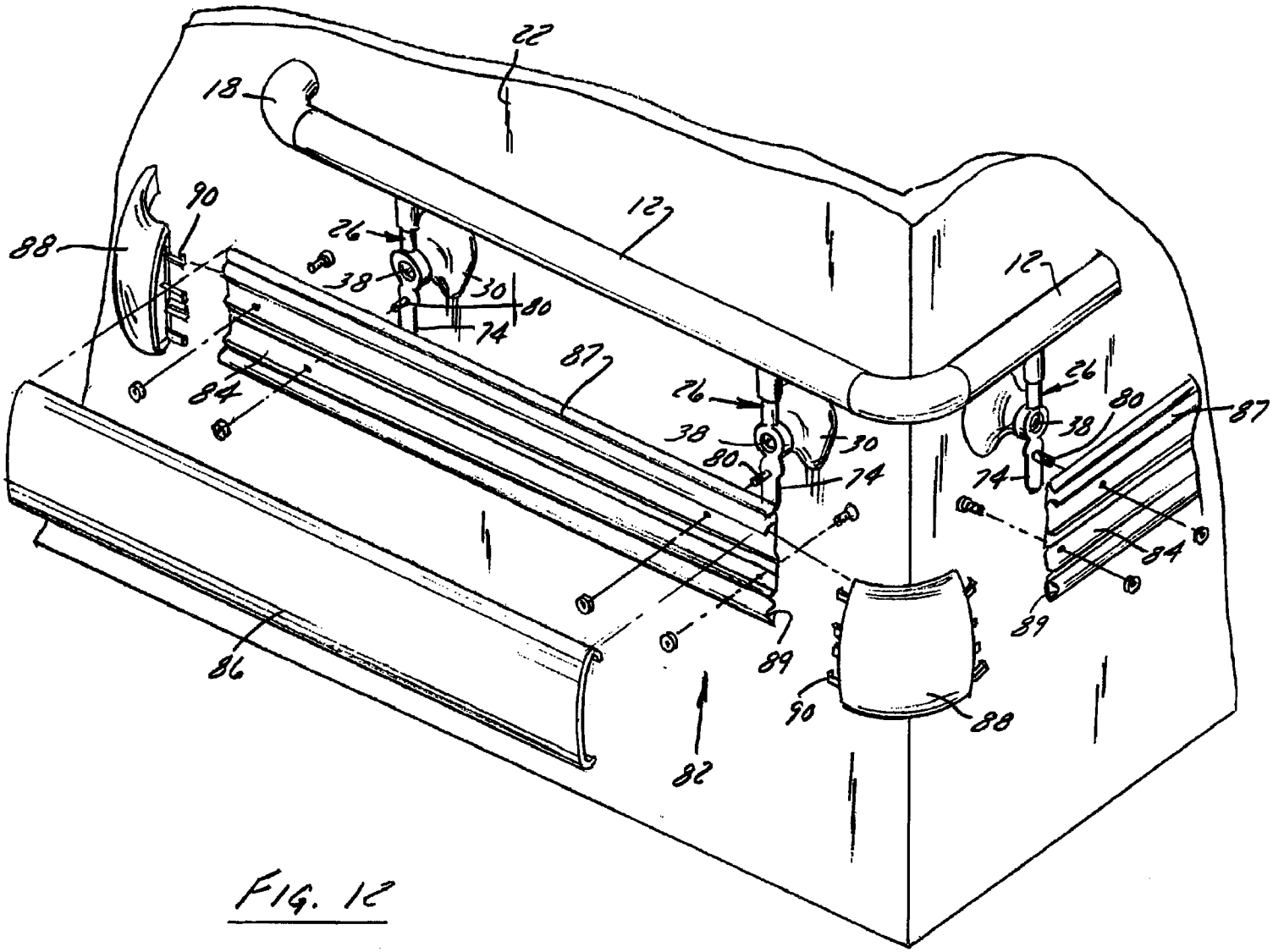
FIG. 12 is a partially exploded view of the handrail assembly according to the present invention interconnected with a wall guard.

In another embodiment of the present invention illustrated in FIG. 12, bracket posts 26 may include extensions 74 that extend downwardly from base 34 thereof. The extensions 74 include a threaded bolt 80 for coupling a wall guard assembly 82 to the handrail assembly 10 of the present invention. The wall guard assembly 82 includes a wall guard retainer 84 for interconnecting to the extensions 74 by way of fasteners through the holes in the wall 22. The wall guard assembly 82 further includes a wall guard cover 86 for fastening to the wall guard retainer 84 as is generally understood in the art. For example, the wall guard cover 86 may be configured to be snap-fit onto the wall guard retainer 84 The wall guard retainer 84 is preferably provided with a number of channels 87 over a length thereof that are configured to receive tabs 90 of corner mold members 88 to secure the corner mold members 88 thereto for fitting around the corners of wall 22. The channels 87 of the wall guard retainer 84 define a number of ends 89 configured to receive tabs 90 of the wall guard corner 88 such that the corner mold members 88 and wall guard retainer are coupled to one another. The wall guard assembly 82 is configured to hide the mounting assemblies 24 from view to provide a safe assembly and an aesthetically pleasing appearance.

The present invention has been described in terms of the preferred embodiment, and it is recognized that equivalents, alternatives, and modifications, aside from those expressly stated, are possible and within the scope of the appending claims. It is further appreciated that the respective features of any one of the embodiments discussed above is not necessarily solely exclusive thereto.

What is claimed is:

1. A handrail assembly comprising:

a elongated railing having a bottom surface that extends substantially across the entire width of the railing and is substantially planar and defining an interior, wherein the interior includes a channel integrally formed with and extending upwardly from the bottom surface of the railing and extending along a length of the railing; and at least one mounting assembly interconnected with the channel, wherein the mounting assembly is configured to secure the handrail assembly to a surface;

wherein the channel includes a grooved portion mating with a portion of the at least one mounting assembly configured to be introduced upwardly through the bottom surface;

wherein the channel comprises an inverted T-shaped cross-section, wherein a horizontally extending portion of the T-shaped cross-section includes an ungrooved portion and the grooved portion is disposed on a vertically extending portion of the T-shaped cross-section.

2. The handrail assembly of claim 1, wherein the channel extends upwardly from a bottom surface of the interior of the railing.

3. The handrail of claim 1, wherein the bottom surface of the railing is generally flat, and wherein the bottom surface is configured to receive a portion of the mounting assembly therethrough.

4. The handrail of claim 1, wherein the mounting assembly comprises a bracket post;

a bolt secured within the bracket post and extending upwardly therefrom for engaging the channel of the railing; and a bracket configured for mounting to the surface, wherein the bracket post is secured to the bracket to secure the handrail assembly to the surface.

5. The handrail of claim 4, wherein the bolt includes a threaded portion and is configured to self-thread into the channel of the railing.

6. The handrail of claim 1, further comprising a corner member selectively coupleable to the railing.

7. The handrail of claim 6, wherein the channel is defined by an integrally formed extrusion extending upwardly from a floor of the interior of the railing, and wherein the integrally formed extrusion includes at least one external groove extending along a length of the extrusion, and wherein the at least one external groove is configured to matingly cooperate with one of the corner member and a second railing.

8. A handrail comprising:

a railing defining an interior and including a bottom surface including a plurality of apertures formed therein, wherein each of the plurality of apertures is positioned at a spaced distance from each of the other of the plurality of apertures;

the railing further comprising an extrusion defining a channel extending over a length of the railing within the interior of the railing, the channel defining a grooved portion, wherein the channel comprises an inverted, T-shaped cross-section including said grooved portion and an non-grooved portion;

a plurality of mounting assemblies secured to the railing at each of the plurality of apertures, the mounting assemblies comprising, a bracket post;

a bolt secured within the bracket post and extending upwardly therefrom to engage the grooved portion of the channel to secure the bracket post to the railing;

a bracket interconnected between the bracket post and a wall for securing the handrail to the wall.

9. The handrail of claim 8, wherein the extrusion includes a pair of grooves extending along a length thereof for coupling an end of the extrusion to an extension member.

10. The handrail of claim 9, wherein the railing is selectively coupleable to at least one additional railing, wherein an end of the channel of the railing is configured to couple the railing to the at least one additional railing for extending the length of the handrail.

11. The handrail of claim 10, wherein the at least one additional railing is a corner member configured to be mounted flush against the wall to define an end of the handrail.

12. A handrail assembly comprising:

an elongate railing assembly having a flat bottom surface and defining a substantially hollow interior;

a channel defined by an extruded surface coupled to the bottom surface and extending upwardly into the interior of the railing assembly, wherein the channel comprises an inverted T-shaped cross-section including a horizontally extending ungrooved portion and a vertically extending grooved portion;

at least one mounting assembly coupled to the channel upwardly through the bottom surface of the railing and configured to secure the handrail assembly to a support surface, wherein the mounting assembly comprises, a bracket post;

a fastener having a threaded surface, wherein the threaded surface of the fastener is secured within the channel to secure the bracket post to the railing;

a bracket coupled to the bracket post and the support surface for securing the handrail assembly to the support surface.

13. The handrail assembly of claim 12, wherein the bracket and the bracket post are coupled to one another by a second fastener that extends horizontally through the bracket and the bracket post and into the support surface to secure the handrail assembly to the support surface.

14. The handrail assembly of claim 13, further comprising a toggle bolt coupled to an end of the second fastener and configured to anchor the second fastener to the support surface.

15. The handrail assembly of claim 12, wherein the channel extends along an entire length of the railing.

16. The handrail assembly of claim 12, wherein the fastener is configured to engage the grooved portion of the channel.

17. The handrail assembly of claim 12, further comprising a second railing coupled to the railing at the extruded surface thereof.

18. A handrail assembly comprising:

an elongate railing having a generally rounded grasping surface integrally formed with a generally flat bottom surface including a plurality of holes formed along a length thereof and a hollow interior;

a channel integrally formed within the hollow interior of the railing extending along the length of the railing and having an upside down T-shaped cross-section wherein a horizontally extending portion of the T-shaped cross-section is defined by the bottom surface and is ungrooved and a vertically extending portion of the T-shaped cross-section is grooved;

a plurality of mounting assemblies configured to be selectively coupled between the railing and a support surface, each of the mounting assemblies comprising, a bracket post, a fastener including a threaded surface configured to be threadably engaged with the grooved portion of the T-shaped cross-section to secure the bracket post to the railing through a respective one of the plurality of holes, and a bracket coupled to the bracket post and the support surface for securing the handrail assembly to a support surface.

* * * * *